US005327209A

United States Patent [19]

Sasanuma et al.

[11] Patent Number: 5,327,209

[45] Date of Patent: Jul. 5, 1994

[54] COLOR IMAGE FORMING APPARATUS

[75] Inventors: Nobuatsu Sasanuma, Yokohama; Hisashi Fukushima, Kawasaki; Haruhiko Moriguchi, Yokohama; Tetsuya Atsumi, Tokyo, all of Japan

[73] Assignee: Canon Kabushiki Kaisha, Tokyo, Japan

[21] Appl. No.: 80,863

[22] Filed: Jun. 24, 1993

[30] Foreign Application Priority Data

Jun. 26, 1992 [JP] Japan ..... 4-193110

[51] Int. Cl.[5] ..... G03G 15/01

[52] U.S. Cl. ..... 355/327; 355/246; 355/208; 346/157

[58] Field of Search ..... 355/326, 327, 328, 245, 355/246, 208, 219; 346/157

[56] References Cited

U.S. PATENT DOCUMENTS

| | | | |
|---|---|---|---|
| 4,841,337 | 6/1989 | Hiratsuka et al. | 355/326 X |
| 4,958,192 | 9/1990 | Kusumoto | 355/326 X |
| 4,959,669 | 9/1990 | Haneda | 346/157 |
| 5,019,859 | 5/1991 | Nash | 355/326 X |
| 5,023,708 | 6/1991 | Maruyama et al. | 346/157 X |
| 5,075,725 | 12/1991 | Rushing et al. | 355/208 |
| 5,225,872 | 7/1993 | Fukushima | 355/208 |
| 5,253,018 | 10/1993 | Takeuchi | 355/246 |
| 5,253,031 | 10/1993 | Kinoshita et al. | 355/327 |

*Primary Examiner*—R. L. Moses

*Attorney, Agent, or Firm*—Fitzpatrick, Cella, Harper & Scinto

[57] ABSTRACT

A color image forming apparatus for automatically setting an image forming condition includes an electrophotographic photosensitive member movable along an endless path; an electrostatic latent image forming device for forming electrostatic latent images for different colors on the photosensitive member; a plurality of developing device containing different color toners, operable corresponding to the electrostatic latent image; a transfer device for overlaying developed images sequentially onto a transfer material; a monitor image forming device for forming a monitor image; a control device for controlling the image forming condition on the basis of the monitor image; wherein detection of the monitor images for the respective developing device is completed with one-half the time required for the photosensitive member to rotate for image formation by all of the developing device.

12 Claims, 7 Drawing Sheets

COLOR IMAGE FORMING APPARATUS

FIELD OF THE INVENTION AND RELATED ART

The present invention relates to an image forming apparatus using an image bearing member, such as a copying machine, a laser beam printer or the like, and to a color image forming apparatus. More particularly, it relates to control means for controlling pattern forming means for forming a test pattern to be monitored for the purpose of checking image formation on the image bearing member.

When an image forming condition is changed at the start of color image formation, or when an ambient condition variation or the like changes, a predetermined monitor pattern (patch pattern) is formed on an image bearing member, and is developed with toner, and the image density thereof is detected. In response to the detection, image forming conditions such as maximum density control and $\gamma$ correction or the like, are carried out, thus stabilizing the image quality.

Referring first to FIGS. 5, 6, 7, 8 and 9, this procedure will be described. A color image forming apparatus 10 comprises an electrophotographic photosensitive drum 15 (image bearing member). A rotary type developing device capable of developing toner images with yellow toner, magenta toner, cyan toner and black toner, and an image transfer drum 5, are disposed around the photosensitive drum 15. In the image forming operation, a full-color original to be reproduced is color-separated by a charge coupled device (CCD) having red, green and blue filters. The color separated images are read as electric signals. The electric signals are sequentially reproduced on a recording material 6 for each color through the following process. The following process is carried out for the yellow, magenta, cyan and black colors, respectively, and therefore, the description will be made as to the yellow color.

The yellow electric signal provided by the CCD, is converted to a modulated laser beam E by a laser driver (not shown) and a laser source (not shown), and the laser beam E is reflected by a polygonal mirror 1 and a mirror 2 and is incident on the photosensitive drum 15 rotating in the direction R1 (counterclockwise direction). By beam projection, a latent image is formed on a photosensitive drum 15 corresponding to the yellow image. The latent image is developed by the rotating developing device 3. At this time, the rotary developing device 3 develops the yellow image by a yellow developing device 3Y. The rotary developing device 3 is disposed relative to the photosensitive drum 15 with a predetermined gap therebetween. By moving the developing device by driving means, the gap is small during developing operation (proximity state), and is large during a non-developing-operation (stand-by state). A yellow image is formed on the photosensitive drum 15, and the yellow image is transferred onto a recording material 6 supported on a surface of the transfer drum 5. The above operation is repeated for the magenta, cyan and black colors. Black development is also effected because it is difficult to represent the black color only by the yellow, magenta and cyan toners. Therefore, the photosensitive drum 15 and the transfer drum 5 are rotated through 4 full turns. After completion of the image forming operation, the recording material 6 is separated from the transfer drum 5, is fixed by a pair of fixing rollers, to form, a color image. When a color image forming apparatus 10 operates through the above-described image forming process, it is desirable that a maximum image density of the image to be formed be known prior to the image forming operation. This is accomplished by a maximum density control process, and the measurements of data to be used in the maximum density control process is carried out through a maximum density measurement. In the maximum density measurement, the light beam from the light source 16 is projected onto a monitor pattern (patch pattern) which is formed as a toner image by the pattern forming means on the photosensitive drum 15, and the beam reflected thereby is detected by a density detecting means (photoreceptor 9 (patch sensor)). At this time, if the circularity is not enough, then the distance between the photosensitive drum 15 and the patch sensor varies with the rotation of the photosensitive drum 15, such that the intensity of the reflected light varies. In view of this, as shown in FIG. 8, two patch sensors A and B are disposed at diametrically opposite positions (180 degrees apart) on the photosensitive drum 15, and an average of the density data at the two positions, is used as a density data.

FIG. 6 is a block diagram of the maximum density control process. The light emitted from the light source 15 and reflected by the patch pattern toner image, is detected by the photoreceptor 9, and is converted to an 8-bit digital signal by an A/D converter 11. The signal is proportional to the intensity of the reflected light, and therefore, it is converted to a density signal by the density converting circuit 12. In the conversion at this time, a conversion profile is used which has been produced using the characteristic property that the color (Y, C, M) toners reflect a main wavelength (957 nm) of the light from the light source 16, that the black toner absorbs it, and that the photosensitive member moderately reflects it. FIG. 7 shows an example of the density conversion profile. When the density signal is lower than a target density, the contrast potential is increased by the density difference by a contrast potential control circuit 13, and when it is higher, the potential is lowered by the density difference. This is accomplished by changing the image forming conditions, such as the charging amount, the exposure amount or the like. The maximum density control process is thus carried out.

FIG. 9 is a timing chart used when respective color patch patterns are formed on the photosensitive drum 15. By way of example, a description will be made as to the yellow patch pattern formation. Through one rotation of the photosensitive drum 15, a latent image is formed by the laser beam E on the photosensitive drum 15, and the yellow developing device 3Y is brought into the proximity position, toward the photosensitive drum 15, and develops the latent image with yellow toner, thus forming the patch pattern. Thereafter, the developing device 3Y is retracted from the proximity position to the stand-by position, thus preparing for the next developing operation. The patch pattern thus formed is exposed to the light from the light source 16, and the light reflected thereby is detected by the patch sensor, so that the density of the patch pattern is measured.

In this manner, the maximum density measurement is carried out for the yellow color. Subsequently, the rotary developing device 3 rotates to effect the developing operation with the next color, and similar operations are repeated for the respective color toners. Thus, the maximum density measurements are completed.

However, this system is effective in the case of a small diameter photosensitive drum 15. When the diameter of the photosensitive drum 15 is large, a long period is required for the rotation of the photosensitive drum, and therefore, the maximum density measurement operation requires a longer period. The peripheral speed of the photosensitive drum is predetermined for the purpose of a predetermined process speed. Therefore, in proportion to the increase of the circumferential length, the time required for one full-turn of the photosensitive drum 15 increases.

SUMMARY OF THE INVENTION

Accordingly, it is a principal object of the present invention to provide a color image forming apparatus and method in which the maximum density measurements can be carried out for a short period of time even if a diameter of a photosensitive drum is large.

According to an aspect of the present invention, there is provided a color image forming apparatus for automatically setting an image forming condition, comprising: an electrophotographic photosensitive member movable along an endless path; electrostatic latent image forming means for forming electrostatic latent images for different colors on the photosensitive member; a plurality of developing means containing different color toners, operable corresponding to the electrostatic latent image; transfer means for overlaying developed images sequentially onto a transfer material; monitor image forming means for forming a monitor image; and control means for controlling the image forming condition on the basis of the monitor image; wherein detection of the monitor images for the respective developing means is completed with one-half the time required for the photosensitive member to rotate for image formation by all of the developing means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

EXAMPLE 1

Figure 1:
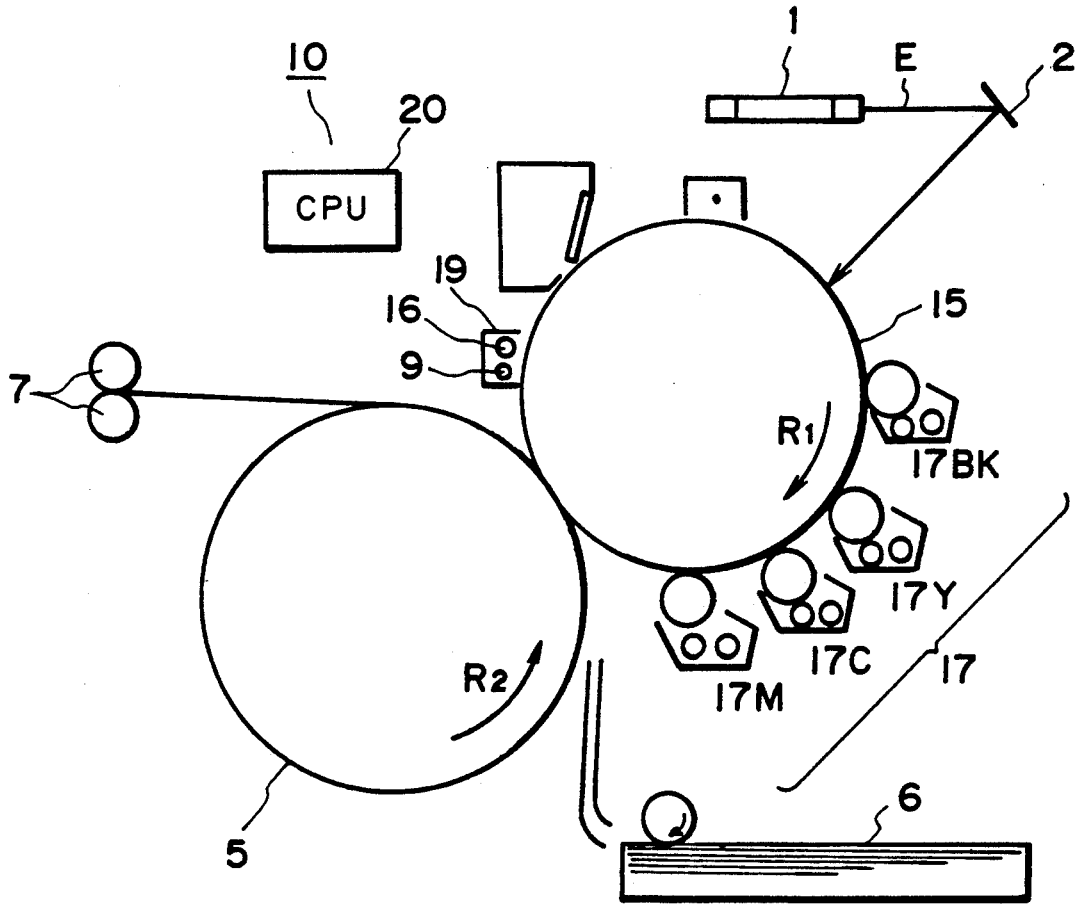
FIG. 1 is a sectional view of an image forming apparatus according to a first embodiment of the present invention.
Figure 2:
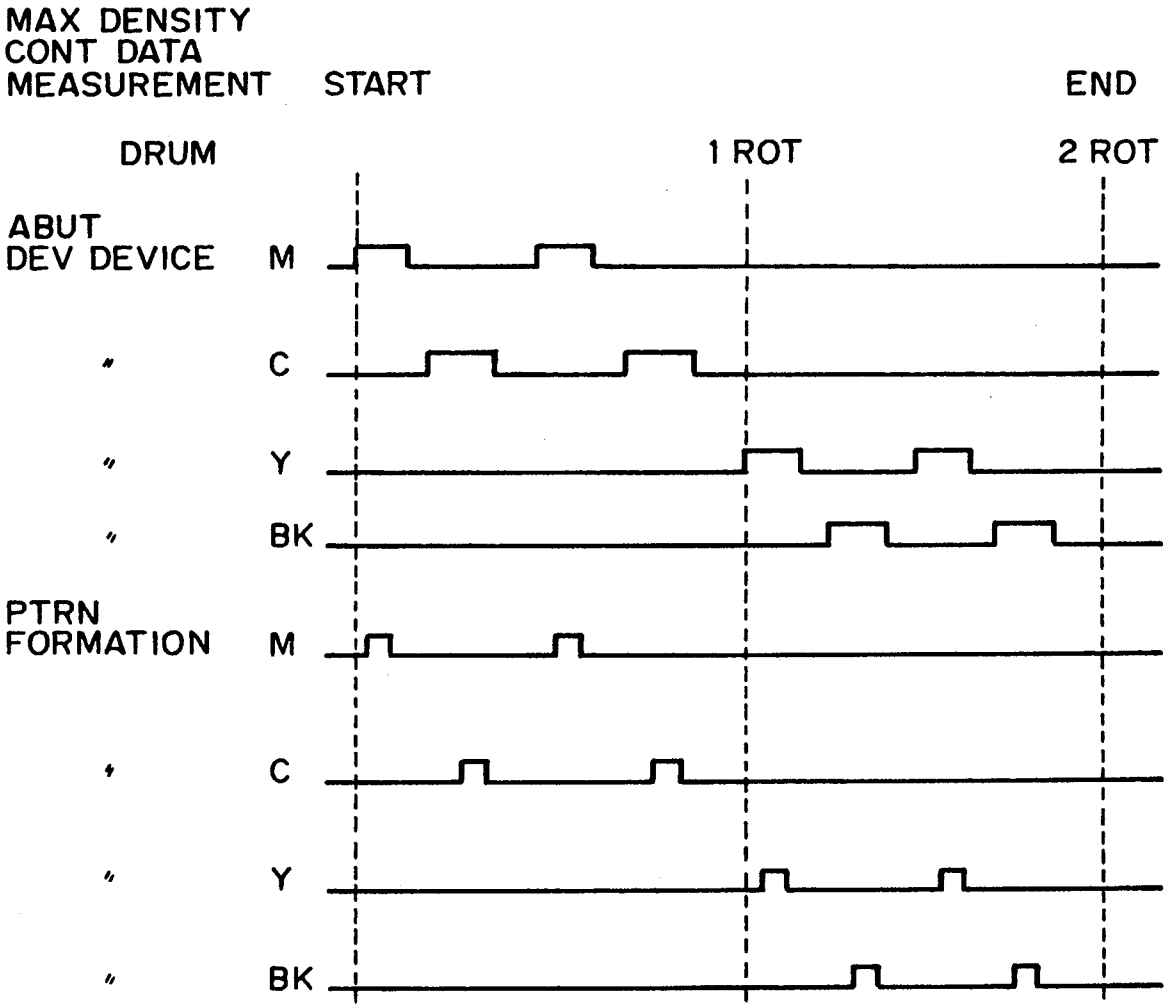
FIG. 2 is an operational timing chart of a developing device used in the apparatus of FIG. 1.

Referring to FIGS. 1 and 2, there is shown a color image forming apparatus 10 according to a first embodiment of the present invention. The color image forming apparatus 10 comprises a photosensitive drum 15 (image bearing member) having a diameter of 120 mm and a peripheral speed of 80 mm/sec. The circumferential surface thereof is enough to form two images of minimum image formation size. Around the photosensitive drum, a transfer drum 5 and a developing device are disposed. The developing device 17 (pattern forming means) comprises a black developing device 17BK, a yellow developing device 17Y, a cyan developing device 17C and a magenta developing device 17M. Around the photosensitive drum 15, a light source 16 and a photoreceptor 9 (patch sensor) constituting a density detecting means for detecting the light reflected, are faced to the photosensitive drum. The image forming apparatus 10 further comprises a polygonal mirror 1 for reflecting and deflecting the laser beam, and a mirror for reflecting the laser beam.

With this structure, the image forming operation is carried out through the following steps under the control of a CPU 20 (control means). First, the original image is color-separated by a charge coupled device (CCD) having red, green and blue filters, and electric signals are produced. At this time, a signal corresponding to black color is separately constituted, so that four color electric signals are produced. The electric signal is converted to a laser beam E by a laser driver (not shown) and a laser source (not shown), and is scanned by a polygonal mirror 1 in the direction of a width of the photosensitive drum 15 (perpendicular to the sheet of the drawing in FIG. 2) (main scan direction), and is reflected by a mirror 2 and is incident on the photosensitive drum 15 rotating in the direction R1. In this manner, a latent image is formed on the photosensitive drum 15 and is developed with a developing device 17. On the transfer drum 5, a recording material 6 fed thereto is wrapped on a transfer drum 5. Therefore, the image formed on the photosensitive drum 15 is transferred onto the recording material 6. The above process is carried out for each of the colors, so that an image is formed on the recording material 6. It is fixed by a pair of fixing rollers into a final color image.

FIG. 2 shows a timing chart of the patch pattern (monitor pattern) forming operation. When the maximum density measurement is started by the CPU 20, the photosensitive drum 15 starts to rotate. Thereafter, the CPU 20 effects the control so as to form the first color (magenta) patch pattern by the magenta developing device 17. In response to the signal, the magenta developing device 17M is brought into the proximity state, and develops the image with the magenta toner. Thereafter, the CPU 20 returns the magenta developing device 17M to the stand-by position, so that the magenta developing device 17M returns to the stand-by position, so that the first magenta patch pattern is formed. In order to detect the density of the first magenta patch pattern, the CPU 20 produces a density detecting signal to the density detecting means 19, and therefore, the first magenta density is detected. Subsequently, when the photosensitive drum 15 rotates through ¼ turn, a process operation similar to the magenta patch pattern formation, is carried out for the cyan color, and a first cyan patch pattern is formed, and the density thereof is detected. When the photosensitive drum 15 rotates through 2/4 rotation, a second magenta patch pattern is formed, and the second magenta density is detected. When it rotates through $\frac{3}{4}$ rotation, a second cyan patch pattern is formed, and a second cyan density is detected. Thus, the photosensitive drum 15 rotates through one full-turn, and an average of the magenta image density and an average of the cyan image density are obtained from the first and second magenta and cyan densities, and the averages are used as data. The same operation is carried out for the yellow and black color, and therefore, the yellow density and the black density are detected, thus completing the maximum density measurement operations.

Accordingly, the maximum density measurements can be carried out through two full-turns of the photosensitive drum 15, and therefore, the time required for the process is one-half (9.4 sec) the conventional process in which a single pattern is formed in a minimum image formation area.

Figure 3:
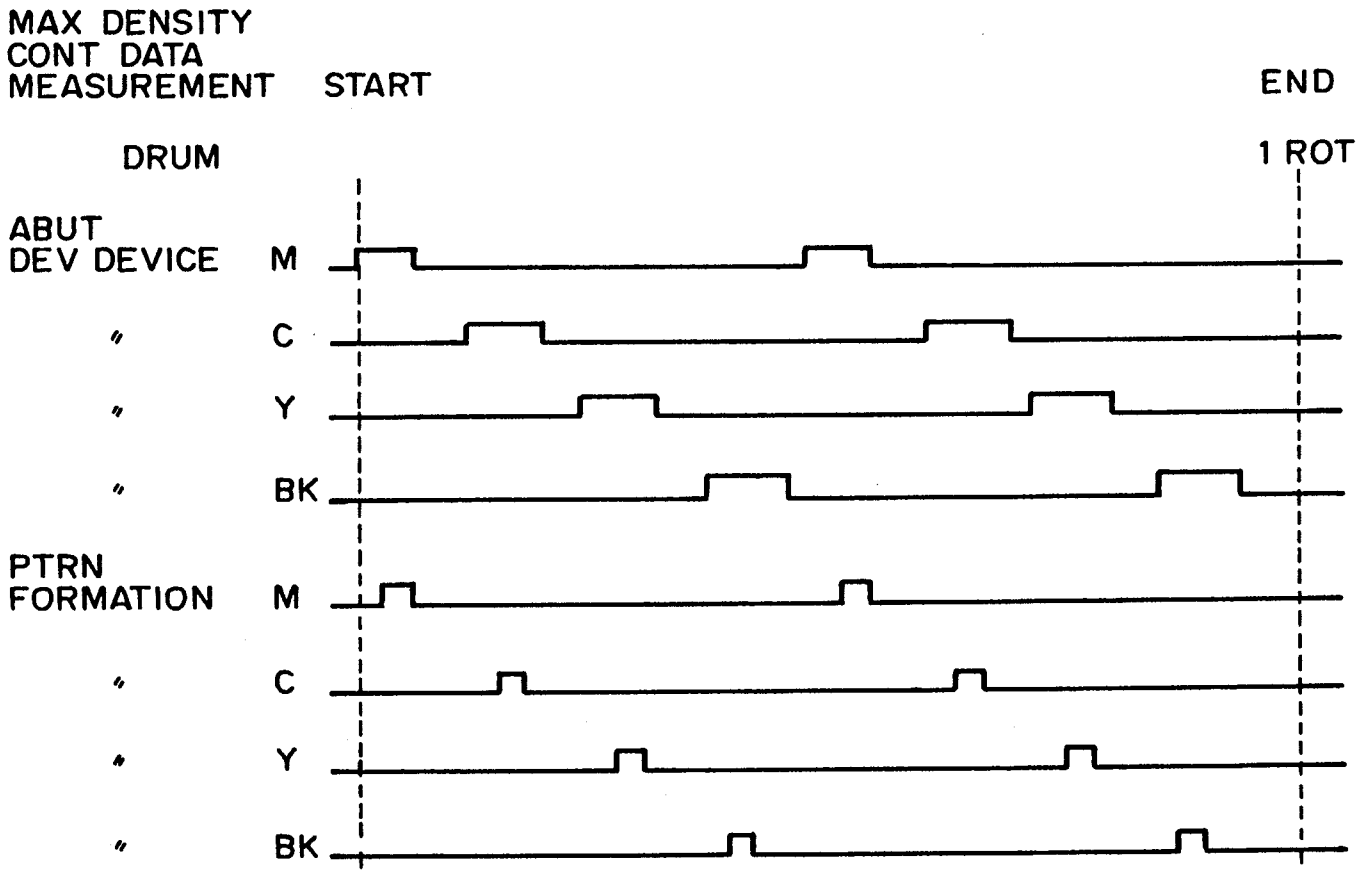
FIG. 3 is an operational timing chart of operation of the developing device used in the apparatus of FIG. 1.

In this embodiment, the formation of the patch pattern is carried out for each $\frac{1}{4}$ rotation of the photosensitive drum 15. However, if it is carried out for $\frac{1}{8}$ rotation of the photosensitive drum 15 as shown in FIG. 3, the process can be completed through one full-turn of the photosensitive drum 15. In this case, the time required for the maximum density measurements is $\frac{1}{4}$ (4.7 sec) the conventional example.

EXAMPLE 2

The fundamental structures of the image forming apparatus 10 of this embodiment are the same as in the first embodiment, and therefore, the detailed descriptions are omitted therefor, and the different points wi 11 be described.

During the developing operation, the developing device is brought to the proximity position, and when the developing operation is not carried out, it is in the stand-by state (large space). The proximity state position and the stand-by state position, are spatially separated, and therefore a certain degree of moving period is required from the proximity state position to the stand-by position (approaching period) and from the stand-by state position to the proximity state position (leaving period). The moving period is different depending on the developing devices, and therefore, the CPU 20 controls the system in consideration of the moving period. If this is not done, it has been found that the scattered toner or the toner on the photosensitive drum contaminates another pattern or another developing device. For example, in the case that after the magenta patch pattern is developed by the magenta developing device 17M the next cyan latent image comes prior to the magenta developing device 17M returning completely to the standby state position, the magenta developing device 17M incompletely develops the cyan patch pattern. Then, it is developed with the cyan developer, with the result that the pattern is formed with a mixture of the magenta toner and the cyan toner, and therefore, the density of each color is not correctly detected.

In this embodiment, consideration is paid to the moving period of the developing device and the position of the developing device so as to avoid the problem described above.

Figure 4:
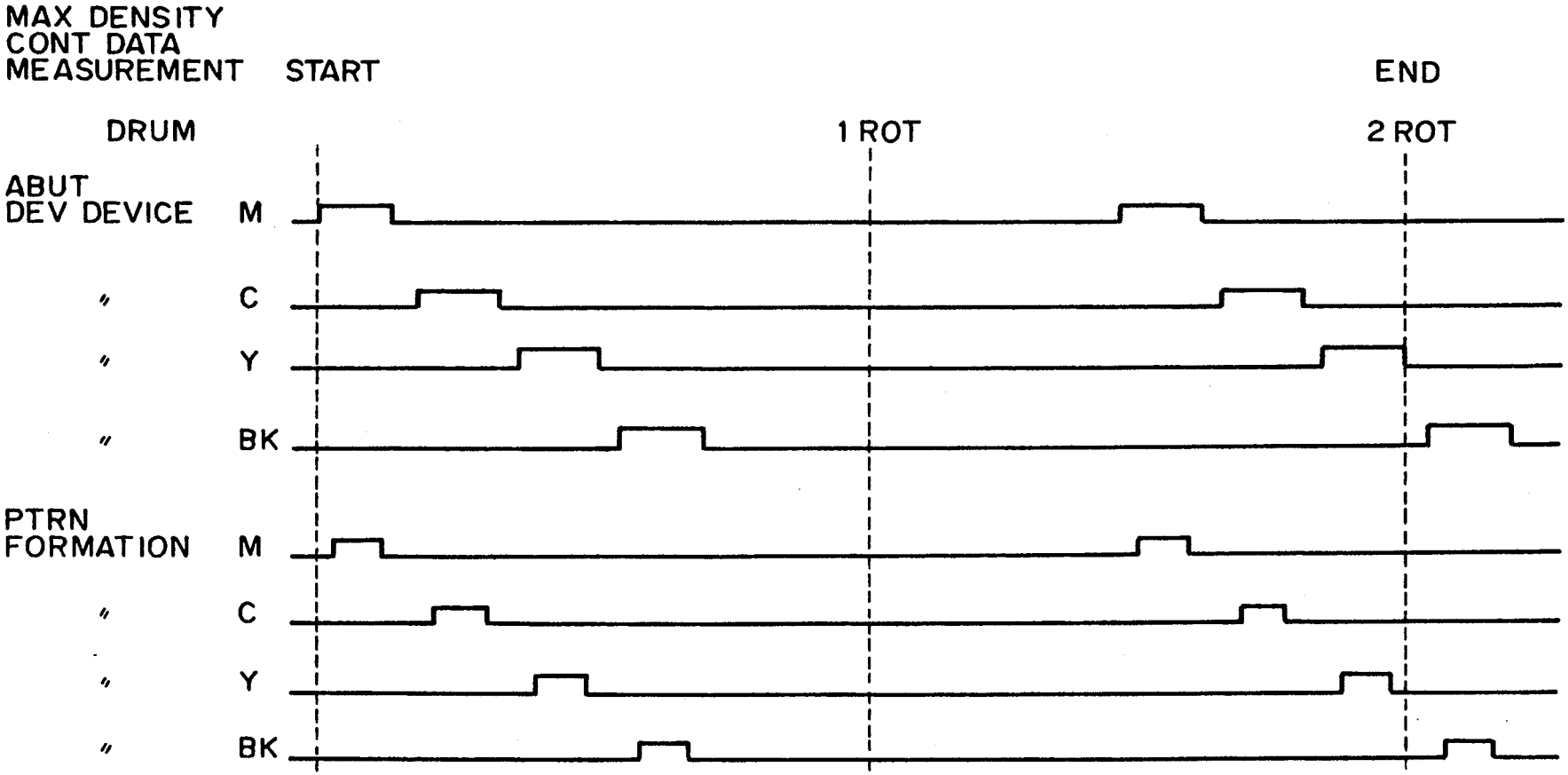
FIG. 4 is an operational timing chart of the developing device according to a second embodiment of the present invention.
Figure 5:
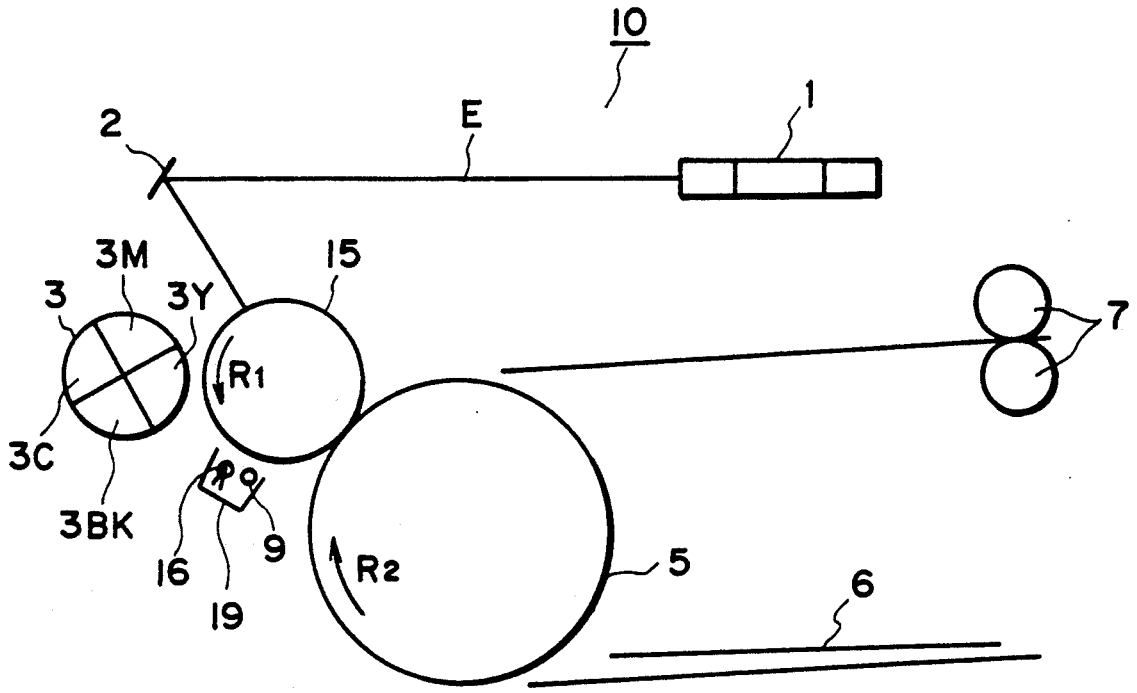
FIG. 5 is a sectional view of a conventional example.
Figure 6:
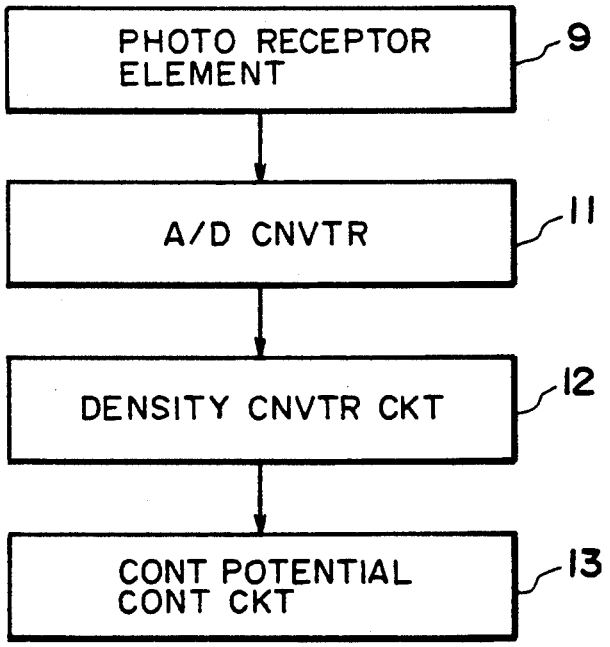
FIG. 6 is a block diagram showing a maximum density control process in a conventional example.
Figure 7:
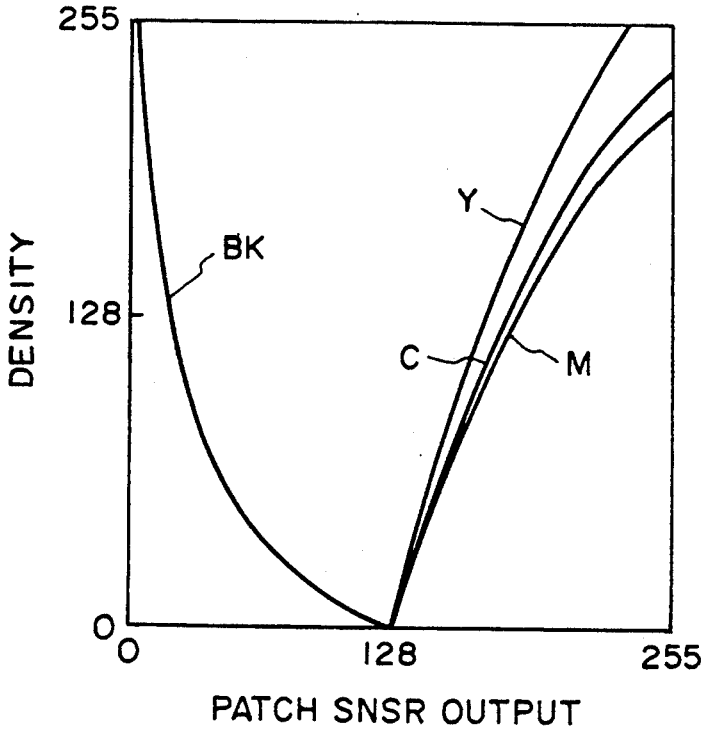
FIG. 7 is a density converter profile representative of a relation between a detected signal by an operational density detecting means and an image density, in a conventional example.
Figure 8:
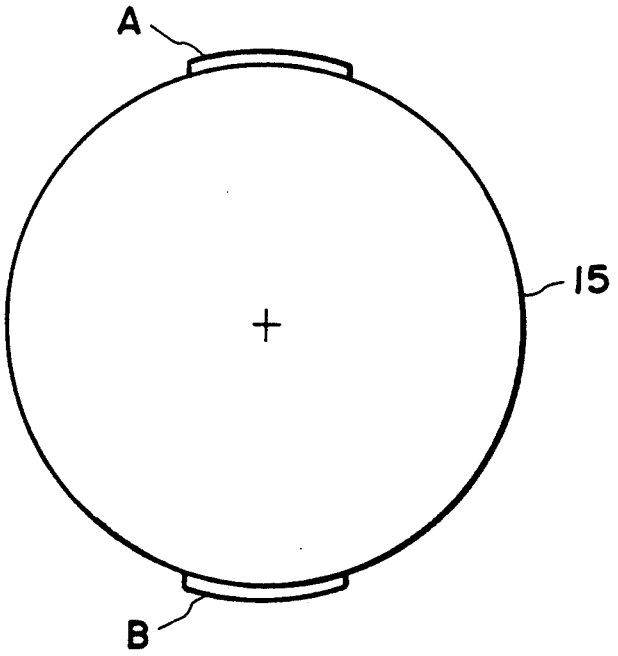
FIG. 8 shows patch pattern positions on the photosensitive drum in a conventional example.
Figure 9:
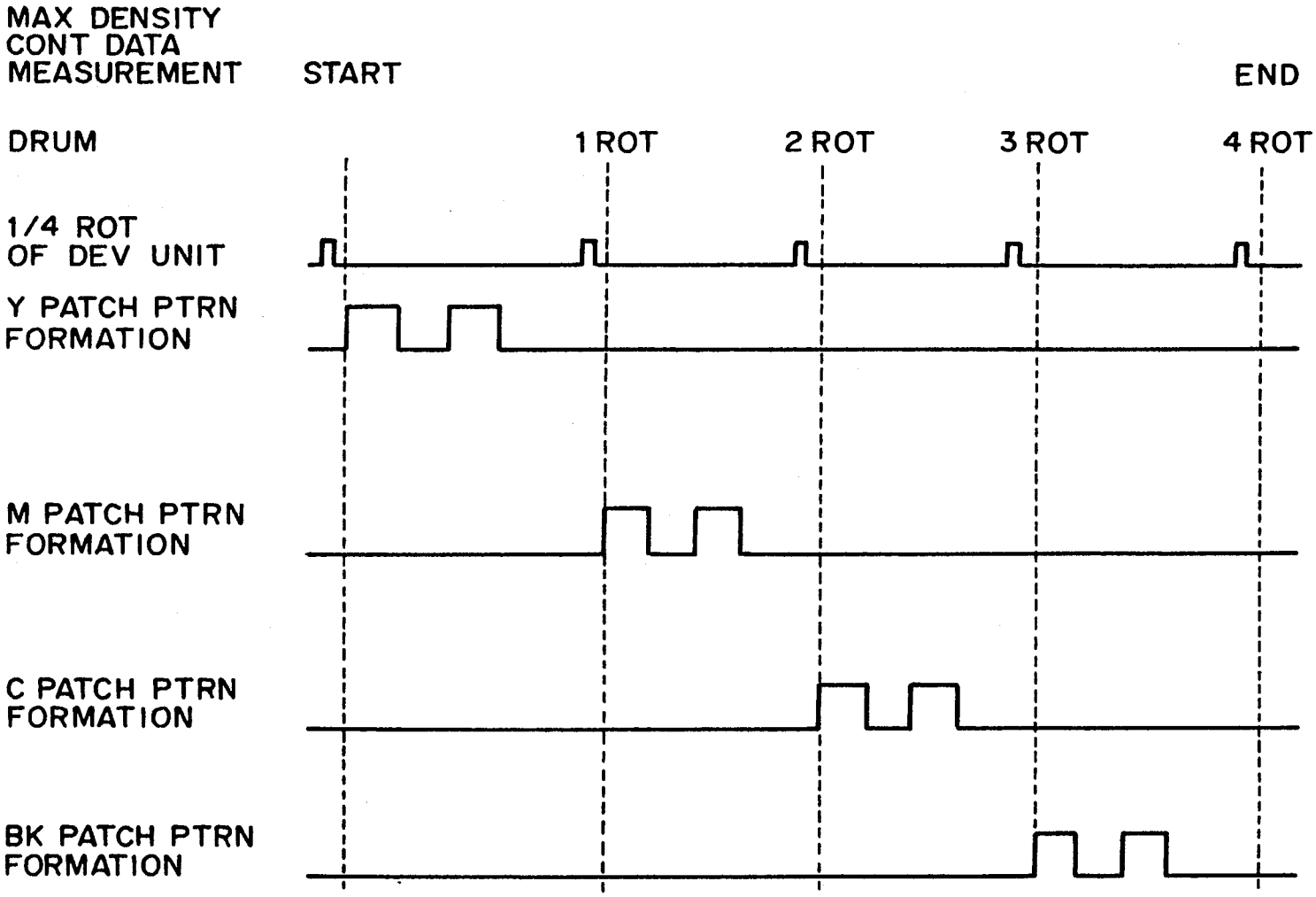
FIG. 9 is an operational timing chart of a conventional developing device.

FIG. 4 shows an operational timing chart of the apparatus of this embodiment. The description will be made in conjunction with FIG. 4.

The CPU 20 stores beforehand the approaching period, departing (leaving) period and the disposed positions of the respective developing devices as time periods, irrespective of individual image formation areas of the photosensitive drum. When the maximum image density measurement operation is started, the CPU permits rotation of the photosensitive drum 15. Thereafter, the CPU 20 calculates the time at which the magenta latent image reaches the magenta developing position 17M on the basis of the stored position information of the magenta developing device 17M. On the basis of the results of calculation, an approaching signal is produced so as to bring the magenta developing device 17M to the proximity state position. The magenta developing device 17M receiving the signal is moved to the proximity state position, and develops the magenta image. After the signal is supplied, the magenta developing device, is returned to the stand-by state, in consideration of the developing period, in response to a stand-by signal. If it is discriminated that the magenta pattern has passed through a position where the cyan developing device 17C effects its developing operation, the proximity signal is supplied to the cyan developing device 17. The above-described operation is executed for cyan, yellow and black colors, and the first patch patterns are formed for the respective colors. When the patch pattern reaches the position of the density detecting means 19, a signal is transmitted to cause the density detecting means to detect the pattern image density. This is carried out for the second patch pattern, and the first and second density data is calculated, and therefore, the maximum density control measurements are completed.

Through this method, the plural color monitor patterns are sequentially formed at predetermined intervals without color mixture even if different type developing devices are used. In addition, the time required for the operation is reduced to 5.2 sec from 18.8 sec.

In this embodiment, the moving period of the developing device is stored, but it is a possible alternative that current positions of the developing devices are detected by detecting means, in response to which the control operation is carried out.

According to this embodiment, the patch pattern forming means is controlled in consideration of the patch pattern forming means and moving period required for the pattern forming means to reach the predetermined position, and the plural color patch pattern formations and patch pattern density detections are possible through at least two turns of the photosensitive drum, and therefore, the time required for the maximum density measurement is reduced to $\frac{1}{4}$ or more.

In the foregoing embodiments, the photosensitive member and the transfer material carrying means are in the form of drums. However, one or both of them may be in the form of a belt. The monitor image is not limited to a toner image but may be an electrostatic latent image. The circumferential length of the photosensitive member is approx. twice the minimum size, but it may be the same size or larger than two or three times.

The monitor image may be a latent image, the potential of which is detected by a known potential detector.

While the invention has been described with reference to the structures disclosed herein, it is not confined to the details set forth and this application is intended to cover such modifications or changes as may come within the purposes of the improvements or the scope of the following claims.

What is claimed is:

1. A color image forming apparatus for automatically setting an image forming condition, comprising:

an electrophotographic photosensitive member movable along an endless path;

electrostatic latent image forming means for forming electrostatic latent images for different colors on said photosensitive member;

a plurality of developing means containing different color .toners, operable corresponding to the electrostatic latent image;

transfer means for overlaying developed images sequentially onto a transfer material;

monitor image and forming means for forming a monitor image;

control means for controlling the image forming condition on the basis of the monitor image;

wherein detection of the monitor images for the respective developing means is completed within one-half the time required for said photosensitive member to rotate for image formation by all of said developing means.

2. An apparatus according to claim 1, wherein the monitor image is a toner image provided by said developing means, and an image density of the toner image is detected.

3. An apparatus according to claim 1, wherein the monitor image is an electrostatic latent image, and a potential of the latent image is detected.

4. An apparatus according to claim 1, wherein said developing means comprises developing devices for developing with yellow, magenta, cyan and black toners, and said photosensitive member rotates through one turn for one color toner image formation.

5. An apparatus according to claim 4, wherein a position of formation of the monitor image is set by rotational angular position of said photosensitive member.

6. An apparatus according to claim 4, wherein a position of formation of said monitor image is set on the basis of a time period required for change of said developing means.

7. A color image forming apparatus for automatically setting an image forming condition, comprising:

an electrophotographic photosensitive member which rotates through one turn for one color image formation;

electrostatic latent image forming means for forming electrostatic latent images for different colors on said photosensitive member;

a plurality of developing means containing yellow, magenta, cyan and black toners, operable corresponding to the electrostatic latent images;

transfer means for overlaying developed images sequentially onto a transfer material;

monitor image forming means for forming a monitor image; and control means for controlling the image forming condition on the basis of the monitor image;

wherein detection of the monitor images for the respective developing means is completed within one-half the time required for said photosensitive member to rotate for image formation by all of said developing means.

8. An apparatus according to claim 7, wherein the monitor image is a toner image provided by said developing means, and an image density of the toner image is detected.

9. An apparatus according to claim 7, wherein the monitor image is an electrostatic latent image, and a potential of the latent image is detected.

10. An apparatus according to claim 7, wherein a position of formation of the monitor image is set by rotational angular position of said photosensitive member.

11. An apparatus according to claim 7, wherein a position of formation of said monitor image is set on the basis of a time period required for change of said developing means.

12. An apparatus according to claim 7, wherein said photosensitive member has two image formation areas in its rotational direction with minimum image formation size, and two monitor images for the same color are formed, for each of two colors, during one rotation of said photosensitive member.

* * * * *

UNITED STATES PATENT AND TRADEMARK OFFICE

CERTIFICATE OF CORRECTION

PATENT NO. 5,327,209

DATED July 5, 1994

INVENTOR(S) SASANUMA ET AL.

It is certified that error appears in the above-indentified patent and that said Letters Patent is hereby corrected as shown below:

[At 57] Abstract

Line 7, "device" should read --devices--.
Line 18, "device" should read --devices--.

Column 1

Line 45, "(counterclockwise" should read --counter-clockwise--.
Line 54, "during" should read --during a--.
Line 56, "non-developing-operation" should read --non-developing operation--.
Line 68, "to form," should read --to form--.

Column 2

Line 15, "between" should read --between the surface of--.
Line 22, "positions," should read --positions--.

Column 3

Line 34, "image;" should read --image,--.
Line 52, "operation of" should be deleted.

Column 4

Line 11, "enough" should read --large enough--.
Line 60, "so that the magenta" should be deleted.
Line 61, should be deleted in its entirety.

UNITED STATES PATENT AND TRADEMARK OFFICE

CERTIFICATE OF CORRECTION

PATENT NO. 5,327,209

DATED July 5, 1994

INVENTOR(S) SASANUMA ET AL.

It is certified that error appears in the above-indentified patent and that said Letters Patent is hereby corrected as shown below:

Column 5

Line 36, "wi 11" should read --will--.

Column 6

Line 21, "device," should read --device--.

Column 7

Line 12, ".toners," should read --toners,--.
Line 17, "image;" should read --image; and--.

Signed and Sealed this

Thirteenth Day of December, 1994

Bruce Lehman

*Attest:*

BRUCE LEHMAN

*Attesting Officer*

*Commissioner of Patents and Trademarks*